US009861170B1

(12) United States Patent
Hamaty

(10) Patent No.: US 9,861,170 B1
(45) Date of Patent: Jan. 9, 2018

(54) ROLLING SUITCASE THAT CONVERTS TO A LUGGAGE CART

(71) Applicant: Robert M. Hamaty, Grand Caymen (KY)

(72) Inventor: Robert M. Hamaty, Grand Caymen (KY)

( * ) Notice: Subject to any disclaimer, the term of this patent is extended or adjusted under 35 U.S.C. 154(b) by 0 days.

(21) Appl. No.: 15/187,978

(22) Filed: Jun. 21, 2016

(51) Int. Cl.

| | |
|---|---|
| ***A45C 5/14*** | (2006.01) |
| ***A45C 9/00*** | (2006.01) |
| ***A45C 5/03*** | (2006.01) |
| ***A45C 5/06*** | (2006.01) |
| ***A45C 13/30*** | (2006.01) |
| ***A45C 13/26*** | (2006.01) |

(52) U.S. Cl.
CPC ..... *A45C 9/00* (2013.01); *A45C 5/03* (2013.01); *A45C 5/06* (2013.01); *A45C 5/143* (2013.01); *A45C 13/262* (2013.01); *A45C 13/30* (2013.01); *A45C 2013/306* (2013.01)

(58) Field of Classification Search
CPC ..... A45C 5/143
USPC ..... 190/18 A, 15.1, 108
See application file for complete search history.

(56) References Cited

U.S. PATENT DOCUMENTS 1,495,093 A * 5/1924 Mock ..... B60B 33/0002 16/38
2,478,563 A * 8/1949 Book ..... A45C 5/143 16/30
3,526,921 A * 9/1970 Aupke ..... A45C 5/143 16/38
3,861,703 A * 1/1975 Gould ..... A45C 5/143 190/18 A
3,960,252 A 6/1976 Cassimally
4,027,754 A * 6/1977 Walker ..... A45C 5/143 16/223
4,340,132 A 7/1982 Cerna
4,422,212 A * 12/1983 Sheiman ..... A45C 5/143 16/29
5,431,262 A 7/1995 Rekuc et al.
(Continued)

FOREIGN PATENT DOCUMENTS

| | | | |
|---|---|---|---|
| DE | 3512844 | A1 | 11/1986 |
| EP | 1862088 | A1 | 12/2007 |
| WO | 2015/164974 | A1 | 11/2015 |

OTHER PUBLICATIONS

Patent Search Report (Patentability Search) from Cardinal Intellectual Property dated Feb. 23, 2016 (18 Pages).

*Primary Examiner* — Sue A Weaver
(74) *Attorney, Agent, or Firm* — Fitch, Even, Tabin & Flannery, LLP

(57) ABSTRACT

A suitcase includes a kit to convert the suitcase to a luggage cart. A typical rolling suitcase additionally includes at least three sockets provided in spaced relation in the major bottom wall of the suitcase base and open to an outside of the suitcase, and at least three stem casters, each stem caster having a wheel rotatable in a housing and a stem attached to the housing, the stem being configured to be removably secured in one of the at least three sockets. When the at least three stem casters are secured in the at least three sockets and the bottom wall of the suitcase base is arranged facing the ground with the wheels of the at least three stem casters touching the ground, the suitcase is useable as a luggage cart by piling at least one further suitcase over the suitcase lid.

13 Claims, 8 Drawing Sheets

(56) References Cited

U.S. PATENT DOCUMENTS

| | | | | | |
|---|---|---|---|---|---|
| 5,934,425 | A * | 8/1999 | Sadow | A45C 13/262 | 16/408 |
| 6,041,900 | A * | 3/2000 | Sadow | A45C 5/14 | 190/115 |
| 6,042,127 | A * | 3/2000 | Rupolo | A45C 5/143 | 280/33.998 |
| 6,116,390 | A * | 9/2000 | Cohen | A45C 5/14 | 190/115 |
| 6,253,892 | B1 * | 7/2001 | Edwards | A45C 5/143 | 190/109 |
| 7,717,440 | B1 | 5/2010 | Baba | | |
| 7,748,508 | B2 | 7/2010 | Lee et al. | | |
| 8,490,765 | B2 | 7/2013 | Lee et al. | | |
| 8,561,769 | B2 | 10/2013 | Andochick | | |
| 8,720,656 | B2 | 5/2014 | Ready | | |
| 2005/0077136 | A1 | 4/2005 | Brannin | | |
| 2008/0217130 | A1 | 9/2008 | Louis | | |
| 2009/0218187 | A1 * | 9/2009 | Chung | A45C 5/143 | 190/18 A |
| 2009/0315284 | A1 | 12/2009 | Osorno | | |
| 2011/0214957 | A1 | 9/2011 | Barnard et al. | | |
| 2012/0228074 | A1 | 9/2012 | Osler | | |
| 2015/0208776 | A1 | 7/2015 | Bennett | | |

* cited by examiner

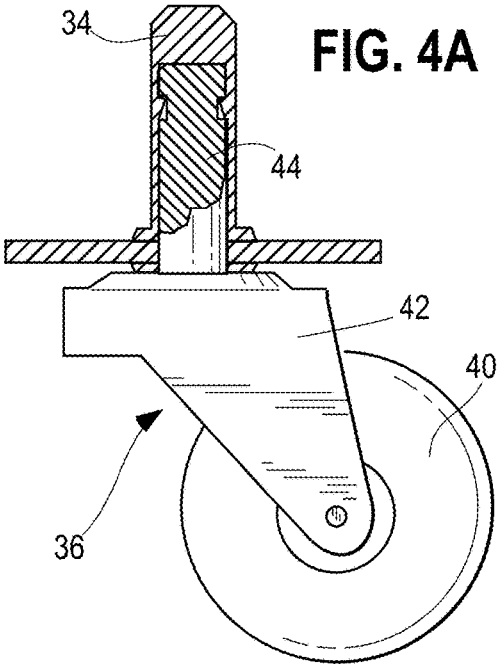
FIG. 4A
FIG.4B
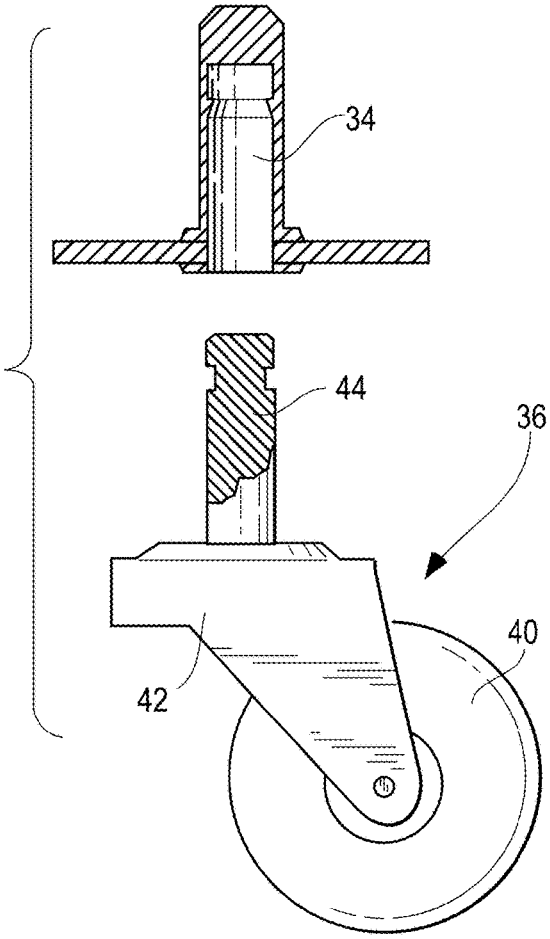

ROLLING SUITCASE THAT CONVERTS TO A LUGGAGE CART

BACKGROUND OF THE INVENTION

Robert Plath, an airline pilot, is generally credited with inventing the modern style rolling suitcase. Plath is the inventor of U.S. Pat. No. 4,995,487, which discloses a luggage assembly comprising a suitcase having integrally connected thereto a laterally extendable handle at its upper end and a wheel assembly (usually a pair of wheels) at its lower end. To effect transport, the handle is moved from a lowered, compact, position to a raised position and the suitcase is tilted from an upright standing position to a canted position in which it is supported solely by its wheels and rolled by pulling said handle. An attachment allows for additional luggage items to be carried by the assembly and transported in a fully balanced manner. This type of rolling suitcase is sold, e.g., under the trademark Rollaboard® by Travelpro International, Inc.

In a variation of this concept, so-called "spinner" suitcases include four wheels at the lower (usually smaller) end. Spinner suitcases are designed for the four wheels to remain level, in contact with the ground or floor and be free spinning, not to be tilted and rolled like two wheeled rolling suitcases.

Rolling luggage is convenient if one is using only a single suitcase or one rolling suitcase and a smaller bag, e.g., a laptop case, that can be carried on top of and attached to the rolling suitcase. However, rolling suitcases become inconvenient when one is traveling with two or more larger suitcases.

Various proposals have been made for combination rolling carts and suitcases. For example, U.S. Pat. No. 8,720,656 discloses combination rolling cart and suitcase that includes a base suitcase, an external support frame, a plurality of steel stabilizers, a plurality of permanent adjustable straps and plurality of attachment points where the attachment points receive and removably couple the permanent adjustable straps to secure one or more suitcases across a top portion of the combination rolling cart and suitcase. The combination rolling cart and suitcase also includes a pair of telescoping handles, a telescoping stem, a releasable handle lock, a plurality of omnidirectional casters and a lid releasably fastened to the base suitcase.

In the various combination rolling cart and suitcase proposals, three or four wheels are installed on the large bottom face of the suitcase. However, having the three or four wheels exposed on the bottom face of the suitcase poses problems for stacking the suitcases in modern airline cargo holds. Therefore, a number of such proposals have complicated arrangements for retracting some or all of the wheels within the bottom face of the suitcase. These disadvantages are likely why such proposals have not been commercially popular.

SUMMARY OF THE INVENTION

It is therefore still desirable to have a modern style rolling suitcase, either of the two-wheeled tilt and rolling type or of the four wheeled spinner type, which can easily be converted into a suitcase cart, but does not have the disadvantage of having permanently installed wheels on its bottom face and/or have the disadvantage of a complicated wheel retraction mechanism.

Therefore, the present invention provides a suitcase including a kit to convert the suitcase to a luggage cart. The suitcase includes a suitcase base having a major bottom wall, opposing front side and rear side walls and opposing top and bottom end walls, the major bottom wall, the front side wall, rear side wall, top end wall and bottom end wall together forming a luggage compartment. A suitcase lid is operably connected to the suitcase base, the suitcase lid having a closed position closing the luggage compartment and an open position allowing access to the luggage compartment in the suitcase base. At least one pair of wheels extends from the bottom end wall of the suitcase base configured to allow the suitcase to be rolled in an upright position with the bottom end parallel to the ground or in a position with the top end tilted toward the user such that the bottom end is tilted from parallel. At least three sockets are installed in spaced relation in the major bottom wall of the suitcase base and open to an outside of the suitcase and at least three stem casters are also provided, each stem caster having a wheel rotatable in a housing and a stem attached to the housing, each stem being configured to be removably secured in one of the at least three sockets. When the at least three stem casters are secured in the at least three sockets and the bottom wall of the suitcase base is arranged facing the ground with the wheels of the at least three stem casters touching the ground, the suitcase is useable as a luggage cart by piling at least one further suitcase over the suitcase lid.

BRIEF DESCRIPTION OF THE DRAWINGS

FIG. 4A is side and partial cross-sectional view of one embodiment of a socket and caster of the present invention in the assembled position; FIG. 4B is side and partial cross-sectional view of one embodiment of a socket and caster of the present invention in the unassembled position.

DETAILED DESCRIPTION OF THE PREFERRED EMBODIMENTS

The present invention provides a suitcase including a kit to convert the suitcase to a luggage cart. The suitcase includes a suitcase base having a major bottom wall, opposing front side and rear side walls and opposing top and bottom end walls, the major bottom wall, the front side wall, rear side wall, top end wall and bottom end wall together forming a luggage compartment. A suitcase lid is operably connected to the suitcase base, the suitcase lid having a closed position closing the luggage compartment and an open position allowing access to the luggage compartment in the suitcase base. At least one pair of wheels extends from the bottom end wall of the suitcase base configured to allow the suitcase to be rolled in an upright position with the bottom end parallel to the ground or in a position with the top end tilted toward the user such that the bottom end is tilted from parallel. Thus, with one pair of wheels extending from the bottom end wall of the suitcase base, the suitcase, when not being used as a luggage cart, is still operational in its basically upright position as a two-wheeled tilt and rolling type suitcase. Similarly, with two pair of spinner-type wheels extending from the bottom end wall of the suitcase base, the suitcase, when not being used as a luggage cart, is still operational in its upright position as a the four wheeled spinner type suitcase.

At least three (preferably four) sockets are installed in spaced relation in the major bottom wall of the suitcase base and open to an outside of the suitcase and at least three (preferably four) stem casters are also provided, each stem caster having a wheel rotatable in a housing and a stem attached to the housing, each stem being configured to be removably secured in one of the at least three sockets. When the at least three (preferably four) stem casters are secured in the at least three (preferably four) sockets and the bottom wall of the suitcase base is arranged facing the ground with the wheels of the at least three stem (preferably four) casters touching the ground, the suitcase is useable as a luggage cart by piling at least one further suitcase over the suitcase lid.

Figure 1:
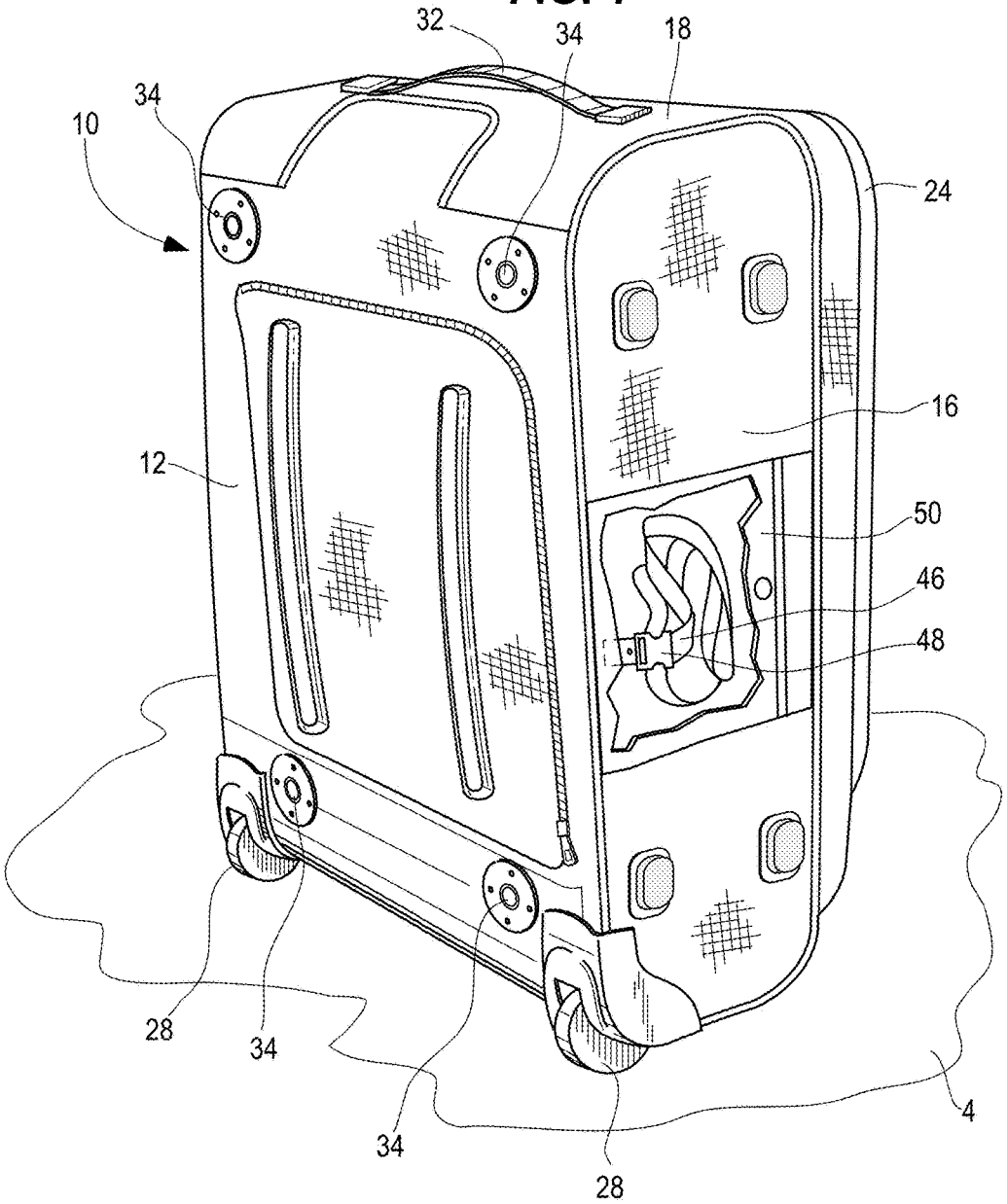
FIG. 1 is a partially cut-away perspective view of one embodiment of the suitcase and kit of the present invention.
Figure 2:
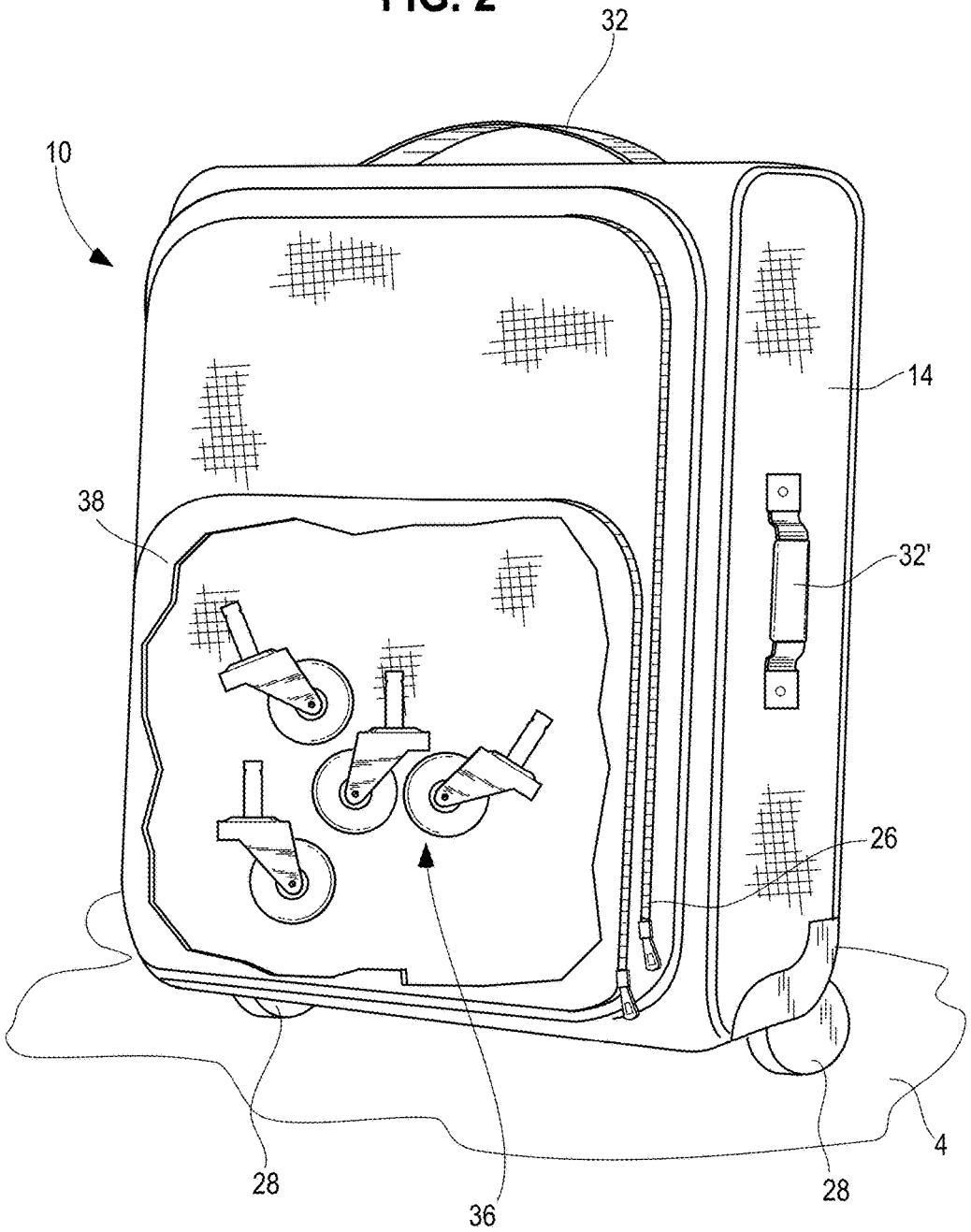
FIG. 2 is another partially cut-away perspective view of one embodiment of the suitcase and kit of the present invention.
Figure 3:
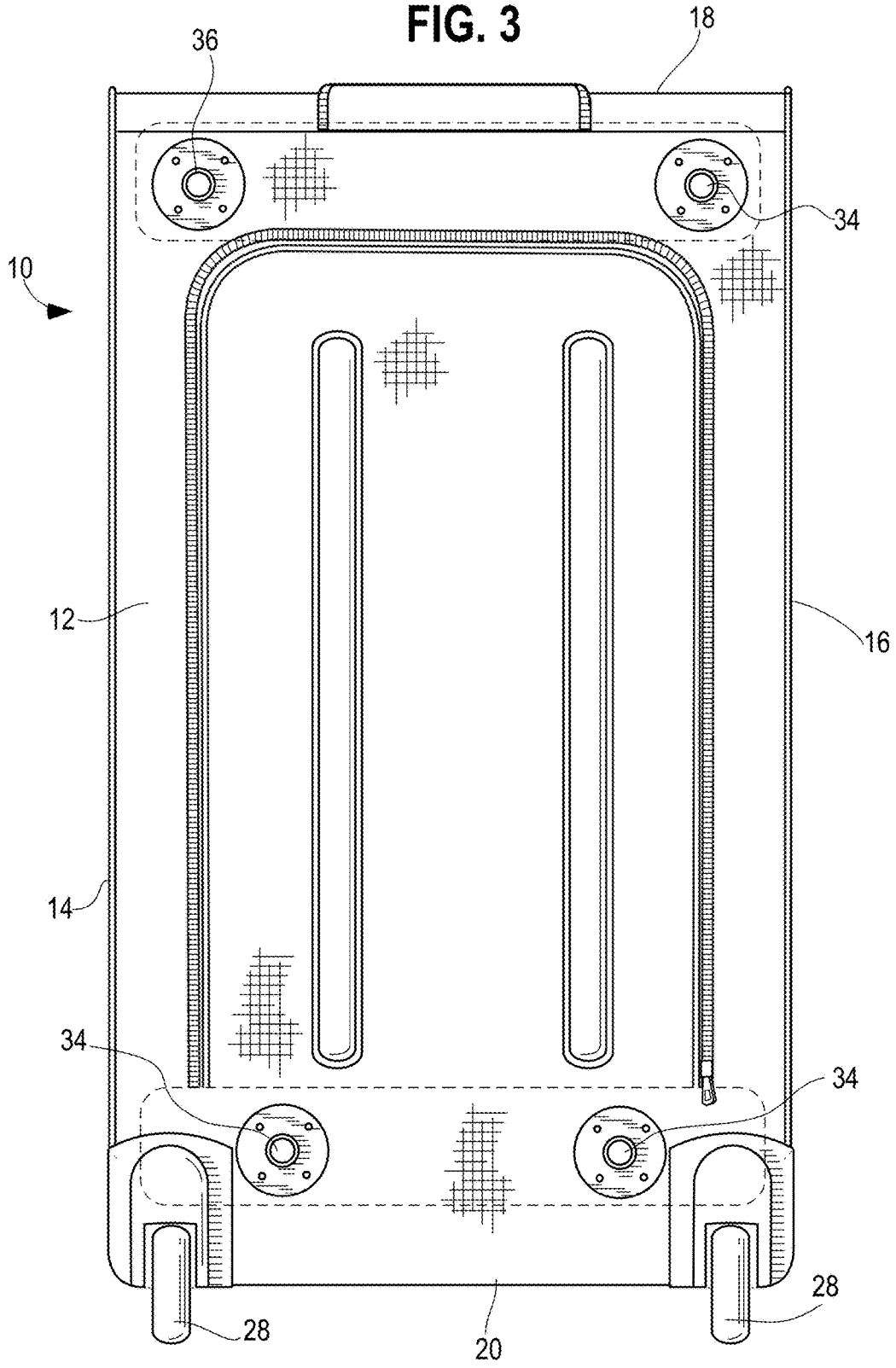
FIG. 3 is a plan view of one embodiment of the suitcase of the present invention showing the major bottom wall.

FIGS. 1 and 2 are partially cut-away perspective views of one embodiment of the suitcase and kit of the present invention (showing opposite sides of the suitcase) and FIG. 3 is a plan view of one embodiment of the suitcase of the present invention showing the major bottom wall. As shown in FIGS. 1-3, The suitcase 10 in this embodiment includes a suitcase base having a major bottom wall 12, opposing front side wall 14 and rear side wall 16 and opposing top end wall 18 and bottom end wall 20, the major bottom wall 12, the front side wall 14, rear side wall 16, top end wall 18 and bottom end wall 20 together forming a luggage compartment 22 (see FIG. 8). A suitcase lid 24 is operably connected to the suitcase base, the suitcase lid 24 having a closed position (e.g., by means of a zipper 26) closing the luggage compartment 22 and an open position (not shown) allowing access to the luggage compartment 22 in the suitcase base. The suitcase 10 in this embodiment is an improved two-wheeled tilt and rolling type suitcase. That is, the suitcase 10 has one pair of wheels 28 extending from the bottom end wall of the suitcase base, the suitcase 10, when not being used as a luggage cart, is still operational in its basically upright position as a two-wheeled tilt and rolling type suitcase.

In the embodiment shown, the suitcase 10 includes a retractable handle 30 as is known in the art having a retracted position with the handle being substantially flush with the top end wall as shown in the figures and an extended position with the handle extending away from the top end wall such that the handle can be used for pulling the suitcase with the top end tilted toward the user as is known in the art. An example of a suitcase having a handle 30' in an extended position with the handle extending away from the top end wall, as is known in the art, is shown for example in connection with the top suitcase in FIG. 5.

Figure 6:
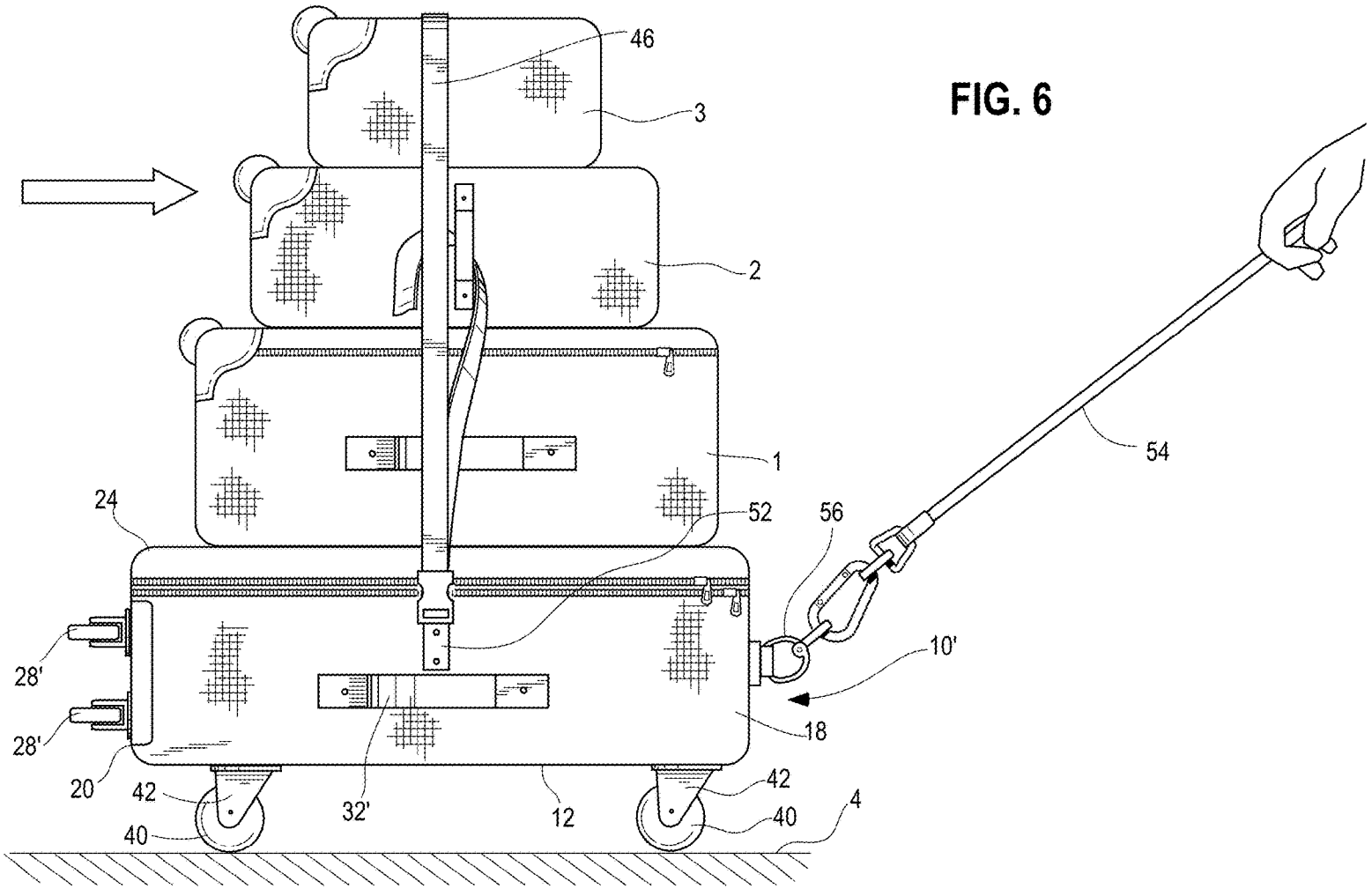
FIG. 6 is a schematic view of another embodiment of the suitcase and kit of the present invention in use.
Figure 7:
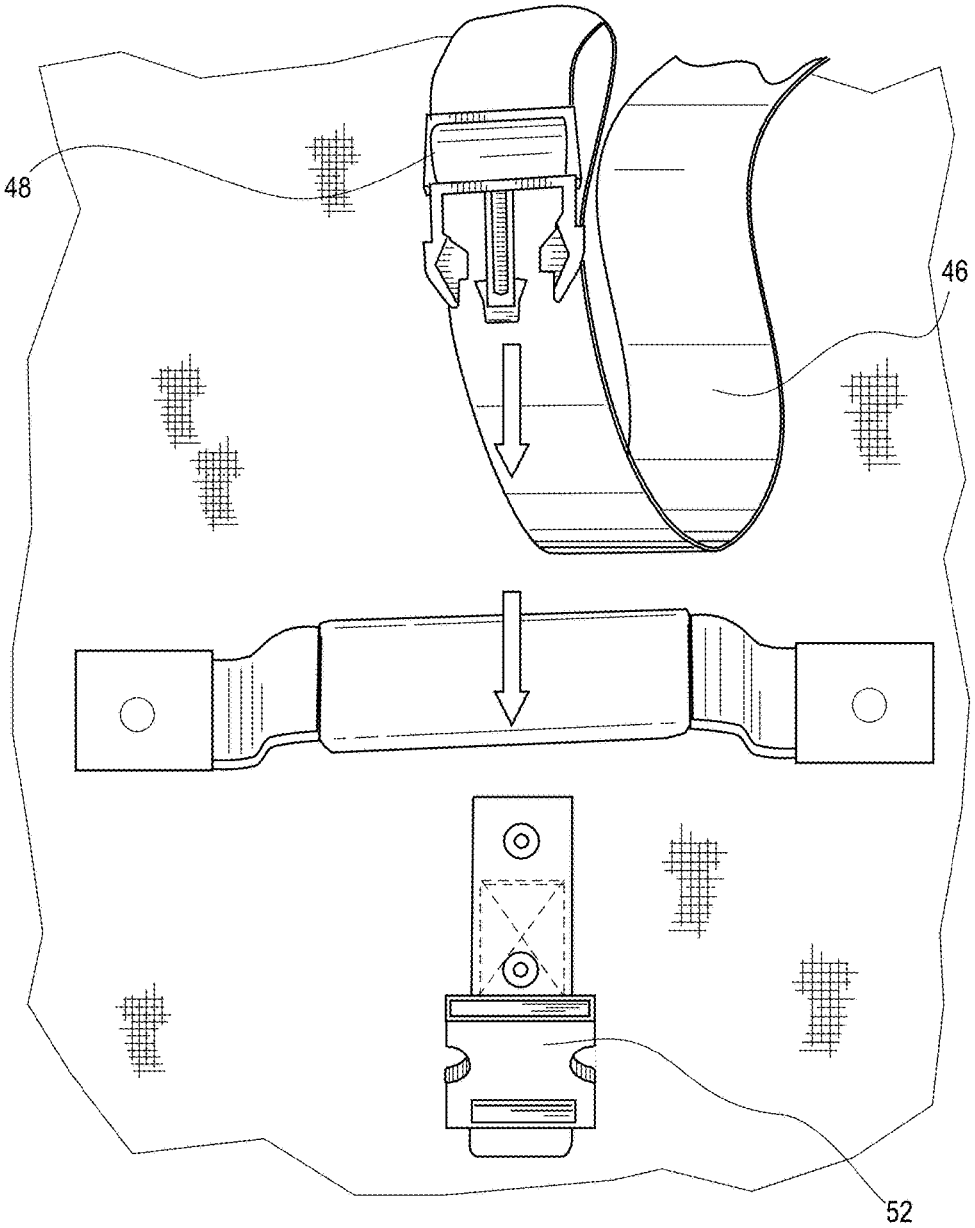
FIG. 7 is a schematic view showing an adjustable length strap to be connected to a connector attached to one side of the suitcase.

In another embodiment, as shown in connection with the suitcase 10' shown in FIG. 6, two pair of spinner-type wheels 28' extend from the bottom end wall 20 of the suitcase base. In this embodiment, the suitcase 10', when not being used as a luggage cart, is still operational in its upright position as a four wheeled spinner type suitcase as is known in the art.

The suitcase 10 may also have one or more fixed handles 32 on its top end wall 18 or 32' on its front side wall 14 (see, e.g., FIG. 2).

The suitcase 10 or 10' of the present invention is modified and improved from, respectively, a typical two-wheeled tilt and rolling type suitcase or a four wheeled spinner type suitcase. As most clearly shown in FIGS. 1 and 3, the suitcase 10 includes at least three (preferably four as shown in this embodiment) sockets 34 installed in spaced relation (adjacent the four corners in the embodiment shown) in the major bottom wall 12 of the suitcase base and open to an outside of the suitcase 10. At least three (preferably four in this embodiment) stem casters 36 are also provided. The stem casters 36 can be stored in any convenient location when not in use, including but not limited to in the suitcase 10 itself or in, e.g., a pocket 38 shown in cut-away view in the lid 24. As more clearly shown in FIGS. 4A and 4B, each stem caster 36 has a wheel 40 rotatable in a housing 42 and a stem 44 attached to the housing 42, each stem 44 being configured to be removably secured in one of the at least three (preferably four) sockets 34 as is known in the caster and housing art. For example and without limitation, as is known in the caster and housing art, the caster stem 44 can be removably secured in the socket 34 of the socket mount by use of an expanding adapter, a friction ring, a grip neck or by being threaded in the socket 34.

Figure 5:
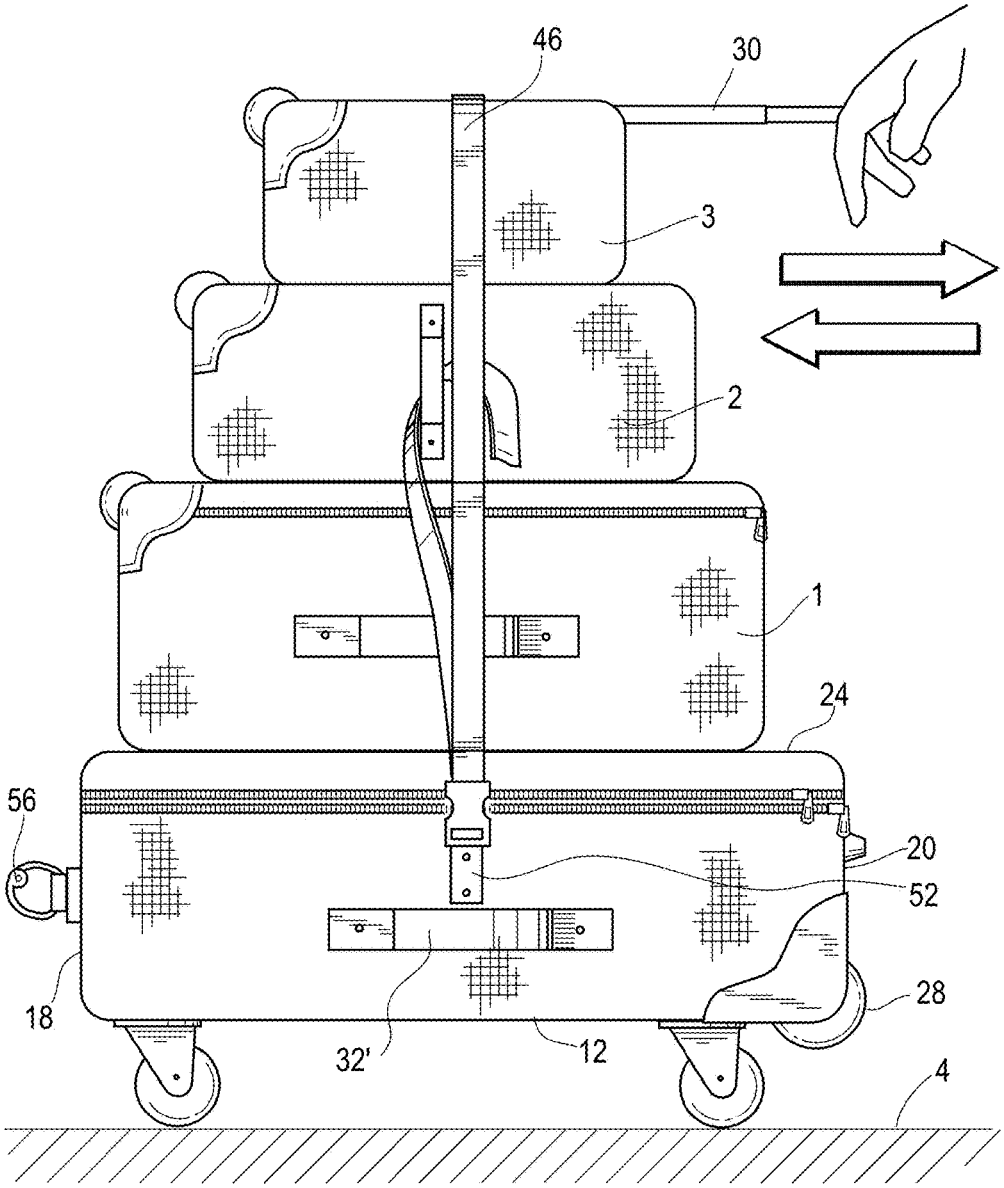
FIG. 5 is a schematic view of one embodiment of the suitcase and kit of the present invention in use.

When the at least three (preferably four) stem casters 36 are secured in the at least three (preferably four) sockets 34 and the bottom wall of the suitcase base is arranged facing the ground 4 with the wheels 40 of the at least three stem (preferably four) casters 36 touching the ground, the suitcase is useable as a luggage cart by piling at least one further suitcase 1, 2, 3 over the suitcase lid 24 as shown in FIGS. 5 and 6. The further suitcases may be any type of suitcase, i.e., possibly, but not necessarily a suitcase of the present invention. One, two, three or four, by way of example, further suitcases may be stacked on the suitcase 10 or 10' of the present invention in its position as a luggage cart.

An adjustable length strap 46 may be provided to secure the further suitcases 1, 2, 3 over the suitcase lid 24 of the suitcase of the present invention. The strap 46 can be made of any material having sufficient strength to secure the further suitcases and can be a bungee-type strap or a canvas-type strap, the length of which can be adjusted with adjustment clips 48 as shown in the figures. When not in use, the strap 46 can be stored in the suitcase 10, e.g., in a pocket 50 provided on the suitcase 10 external to the luggage compartment. In the embodiment shown, the suitcase includes connectors 52 attached to opposing sides of the suitcase configured to connect, e.g., by male and female clips, to ends of the adjustable length strap 46.

In one embodiment shown in FIG. 6, a flexible strap 54 may be provided and may be connectable to at least one of the top end and the bottom end of the suitcase e.g., to ring 56. The flexible strap 54 is configured to be used to pull the suitcase 10 or 10' when it is being used as a luggage cart.

It is also possible to use the handle, e.g., a retractable handle 30' of one of the further suitcases 1, 2, 3, as shown in FIG. 5, to push or pull the stacked suitcases.

Figure 8:
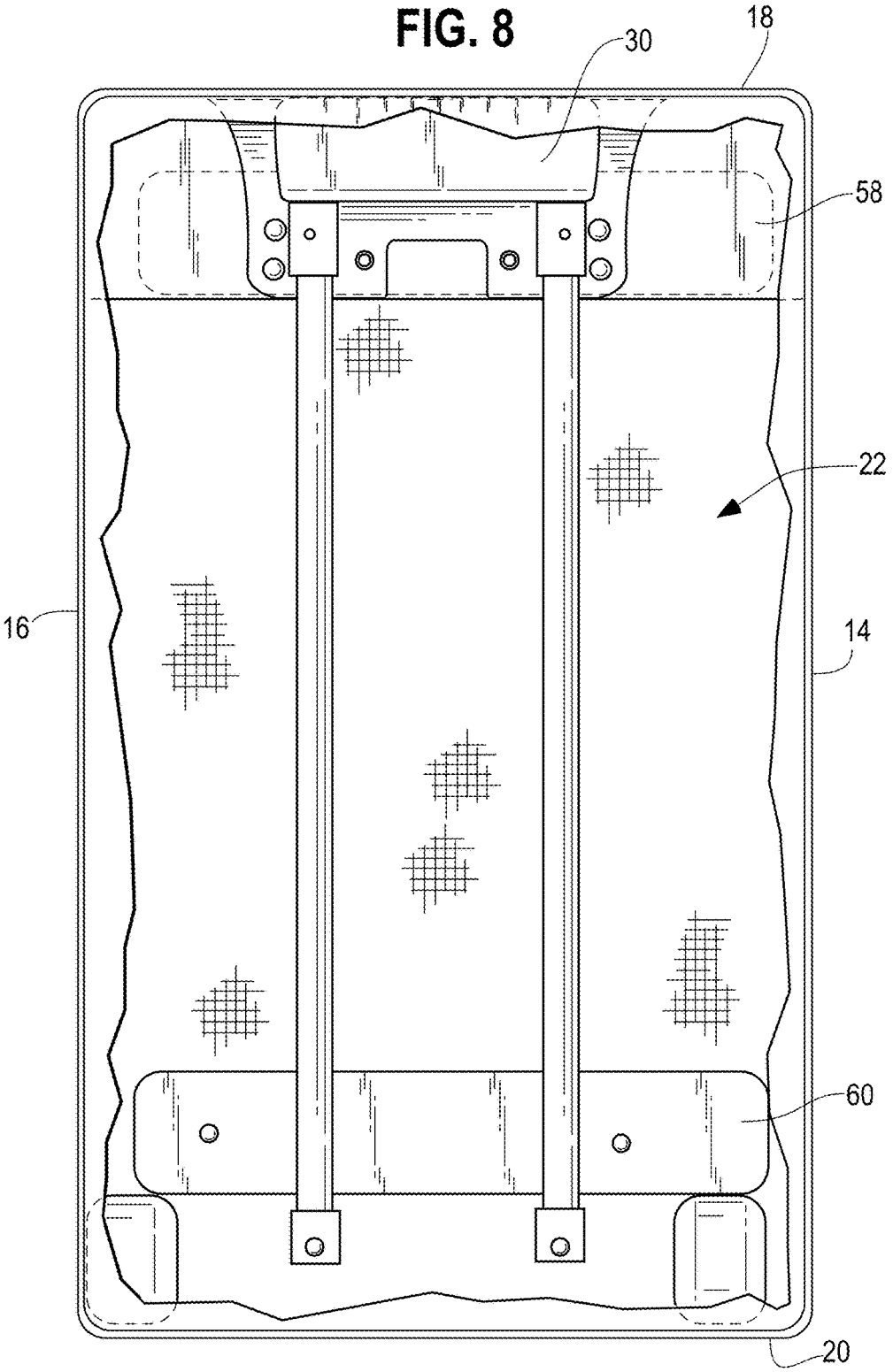
FIG. 8 is a partially cut-away top plan view of an inside of the luggage compartment of one embodiment of the present invention.

The bottom 12 of the suitcase is strengthened to receive the sockets 34 and casters 36 and to support the further suitcase(s) 1, 2, 3 that will be stacked on the suitcase 10 or 10' in the luggage cart position. For example, as shown in the embodiment of FIG. 8, which is a partially cut-away top plan view of an inside of the luggage compartment 22 of the present invention, two rigid or semi-rigid reinforcement pieces 58, 60 can be installed to receive and support the sockets 34. Different size casters and sockets may be used and, if desired, the opposing front side and rear side walls and opposing top and bottom end walls may be strengthened to support heavier stacked further suitcases.

The number of suitcases that can be stacked on the suitcase of the present invention is not particularly limited as long as the suitcase of the present invention is strengthened as noted above to support heavier stacked further suitcases. In the embodiments shown in FIGS. 5 and 6, three additional suitcases are shown stacked on the suitcase of the present invention. With three suitcases stacked on the suitcase of the present invention, one can still see over the top of the stack if pushing the suitcases. Of course, more suitcases can be stacked on the suitcase of the present invention, especially if pulling the suitcases, and of course less than three additional suitcases, i.e., one or two could also be stacked on the suitcase of the present invention.

Thus, the suitcase of the present invention, when not being used as a luggage cart, is still operational in its basically upright position as a two-wheeled tilt and rolling type suitcase or a four-wheeled spinner type suitcase. However, by including a kit comprising at least three casters, the suitcase of the present invention can be converted to a luggage cart. The kit may but does not necessarily also include an adjustable strap for securing further suitcases on the suitcase of the present invention in its luggage cart position and/or a flexible strap connectable to at least one of the top end and the bottom end of the suitcase and configured to be used to pull the suitcase when it is being used as a luggage cart.

What is claimed is:

1. A suitcase, including a kit to convert the suitcase to a luggage cart, comprising:

a suitcase base having a major bottom wall, opposing front side and rear side walls and opposing top and bottom end walls, the major bottom wall, the front side wall, rear side wall, top end wall and bottom end wall together forming a luggage compartment;

a suitcase lid operably connected to the suitcase base, the suitcase lid having a closed position closing the luggage compartment and an open position allowing access to the luggage compartment in the suitcase base;

at least one pair of wheels extending from the bottom end wall of the suitcase base configured to allow the suitcase to be rolled in an upright position with the bottom end parallel to the ground or in a position with the top end tilted toward the user such that the bottom end is tilted from parallel;

at least three sockets installed in spaced relation in the major bottom wall of the suitcase base and open to an outside of the suitcase; and at least three stem casters, each stem caster having a wheel rotatable in a housing and a stem attached to the housing, each stem being configured to be removably secured in one of the at least three sockets, whereby when the at least three stem casters are secured in the at least three sockets and the bottom wall of the suitcase base is arranged facing the ground with the wheels of the at least three stem casters touching the ground, the suitcase is useable as a luggage cart by piling at least one further suitcase over the suitcase lid.

2. The suitcase and kit according to claim 1, wherein one pair of wheels is provided extending from the bottom end wall of the suitcase base, the one pair of wheels configured to allow the suitcase to be rolled in a position with the top end tilted toward the user such that the bottom end is tilted from parallel.

3. The suitcase and kit according to claim 2, further comprising a retractable handle having a retracted position with the handle being substantially flush with the top end wall and an extended position with the handle extending away from the top end wall such that the handle can be used for pulling the suitcase with the top end tilted toward the user.

4. The suitcase and kit according to claim 1, wherein two pairs of wheels are provided extending from the bottom end wall of the suitcase base, the two pairs of wheels being configured to allow the suitcase to be rolled in an upright position with the bottom end parallel to the ground.

5. The suitcase and kit according to claim 4, further comprising a retractable handle having a retracted position with the handle being substantially flush with the top end wall and an extended position with the handle extending away from the top end wall such that the handle can be used for pushing or pulling the suitcase in an upright position with the bottom end parallel to the ground.

6. The suitcase and kit according to claim 1, wherein four sockets are installed adjacent respective four corners of the major bottom wall of the suitcase base; and four stem casters are provided, each stem caster having a wheel rotatable in a housing and a stem attached to the housing, the stem being configured to be removably secured in one of the four sockets.

7. The suitcase and kit according to claim 1, further comprising an adjustable length strap connectable to the suitcase for securing the at least one further suitcase over the suitcase lid.

8. The suitcase and kit according to claim 7, further comprising a pocket provided on the suitcase external to the luggage compartment for storing the adjustable length strap.

9. The suitcase and kit according to claim 7, further comprising connectors attached to opposing sides of the suitcase configured to connect to ends of the adjustable length strap.

10. The suitcase and kit according to claim 1, further comprising a pocket for storing the at least three stem casters.

11. The suitcase and kit according to claim 1, further comprising a flexible strap connectable to at least one of the top end and the bottom end of the suitcase configured to be used to pull the suitcase when it is being used as a luggage cart.

12. The suitcase and kit according to claim 1, further comprising at least one reinforcement piece installed inside the major bottom wall of the suitcase, wherein the at least three sockets are received in and supported by the at least one reinforcement piece.

13. The suitcase and kit according to claim 1, wherein the opposing front side and rear side walls and opposing top and bottom end walls are reinforced to support further suitcases stacked on top of the suitcase lid.

* * * * *